US006089727A

United States Patent [19]

Wu

[11] Patent Number: 6,089,727

[45] Date of Patent: Jul. 18, 2000

[54] ILLUMINATING UMBRELLA HAVING RELIABLE CONNECTING WIRES

[76] Inventor: Tzun-Zong Wu, 8F, No. 76, Lane 103, Nei-Hu Road, Sec. 2, Taipei, Taiwan

[21] Appl. No.: 09/157,464

[22] Filed: Sep. 18, 1998

[51] Int. Cl.[7] ..... A45B 3/02

[52] U.S. Cl. ..... 362/102; 362/800; 135/910

[58] Field of Search ..... 362/102, 800, 362/184; 135/16, 910

[56] References Cited

U.S. PATENT DOCUMENTS 5,323,798 6/1994 Yang ..... 362/102

5,502,624 3/1996 Tu ..... 362/102

*Primary Examiner*—Thomas M. Sember

[57] ABSTRACT

An illuminating umbrella includes a top illuminator fixed on a top end of an umbrella central shaft, and a plurality of tip illuminators respectively fixed on a plurality of tips of the top ribs of the umbrella. Each illuminator has a positive wire electrically connected to a positive conducting ring secured on an outer peripheral portion of an umbrella notch or ferrule formed on an upper end of the central shaft, and a negative wire electrically connected to a negative conducting ring embedded on the central shaft which serves as a negative conductor. The positive conducting ring is electrically connected to a positive pole of a power source, of which the negative pole is electrically connected to the central shaft through an on-off switch slidably held on a grip of the shaft thereby forming a reliable stable power connection circuit among the illuminators and the power source. A flasher is connected between the power source and the illuminators for flashing the illuminators when turned on.

8 Claims, 8 Drawing Sheets

FIG. 7
FIG. 8
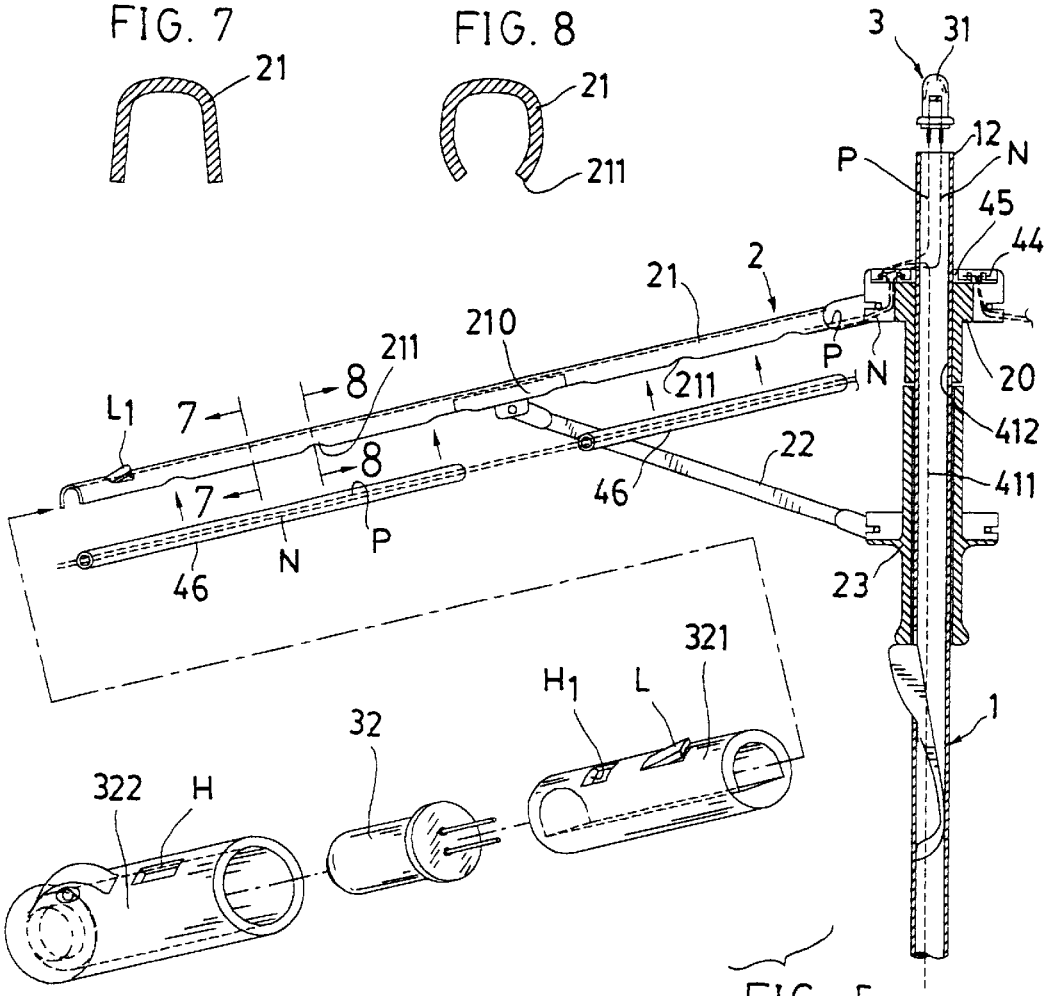
FIG. 5
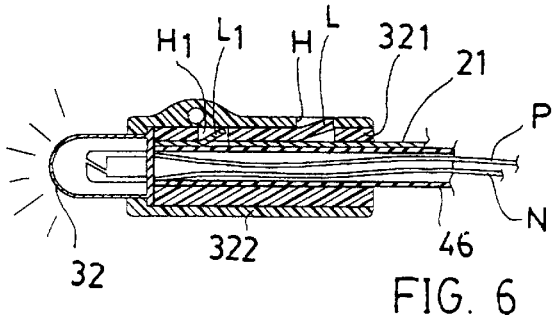
FIG. 6

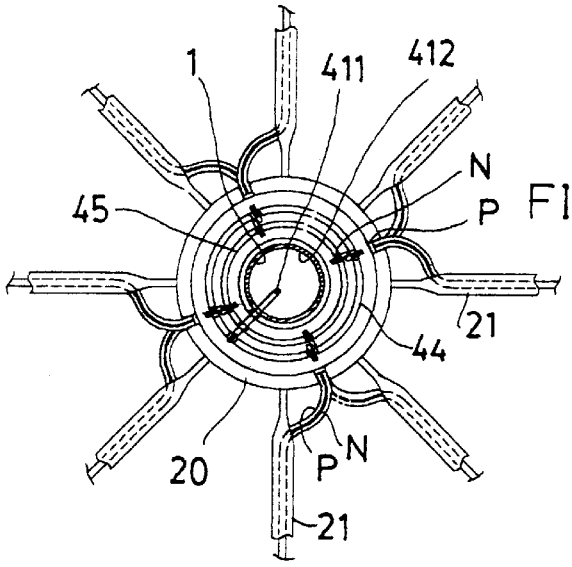
FIG. 11
FIG. 10
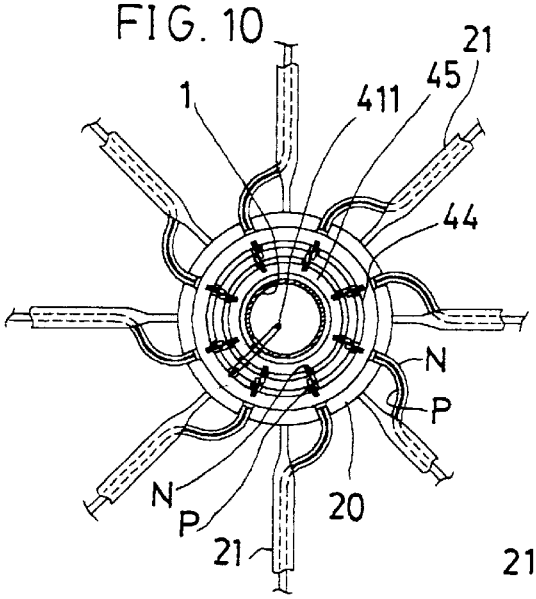
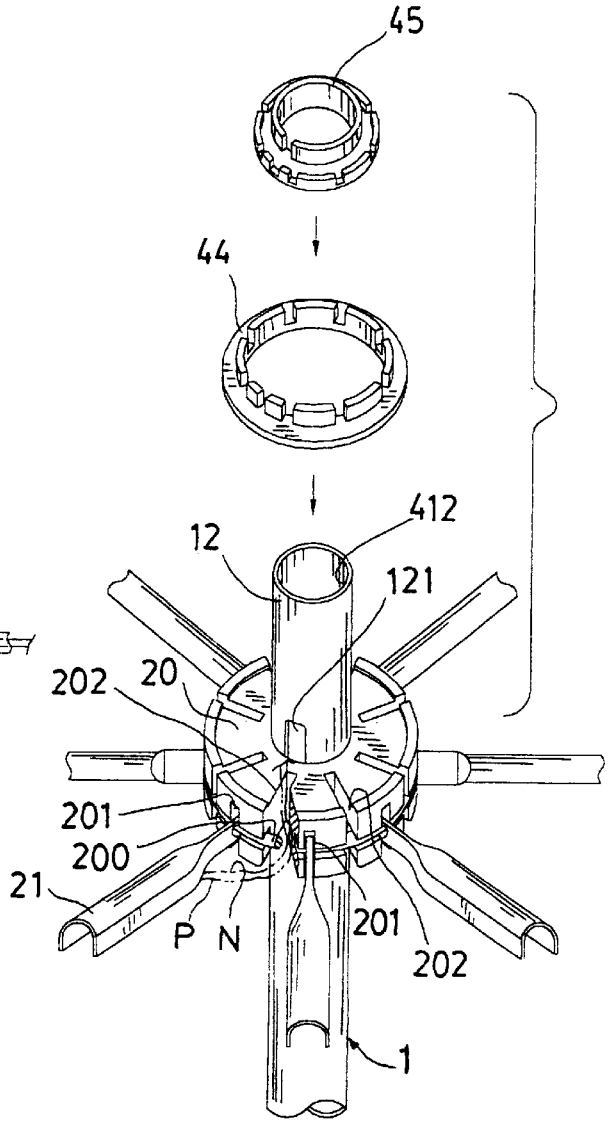
FIG. 9

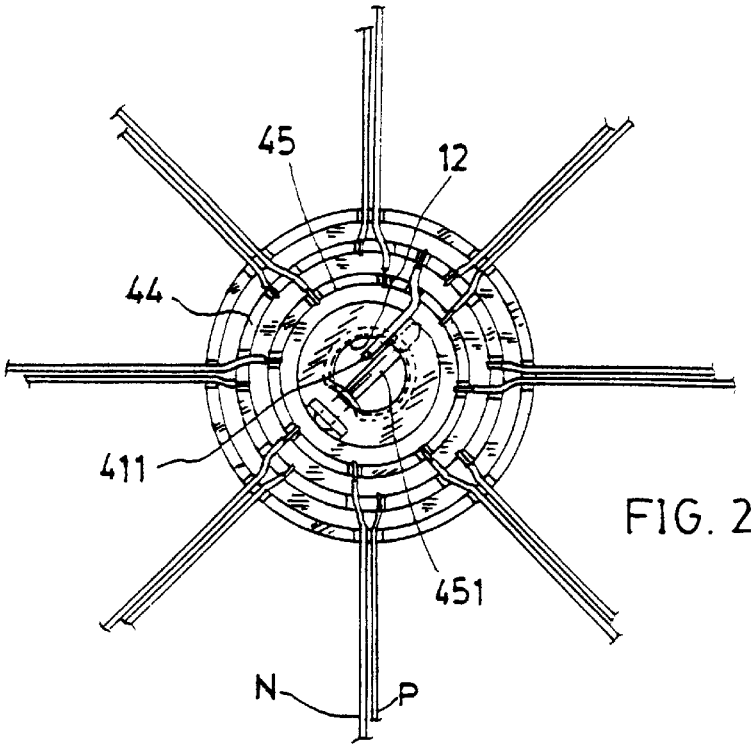
FIG. 20
FIG. 19
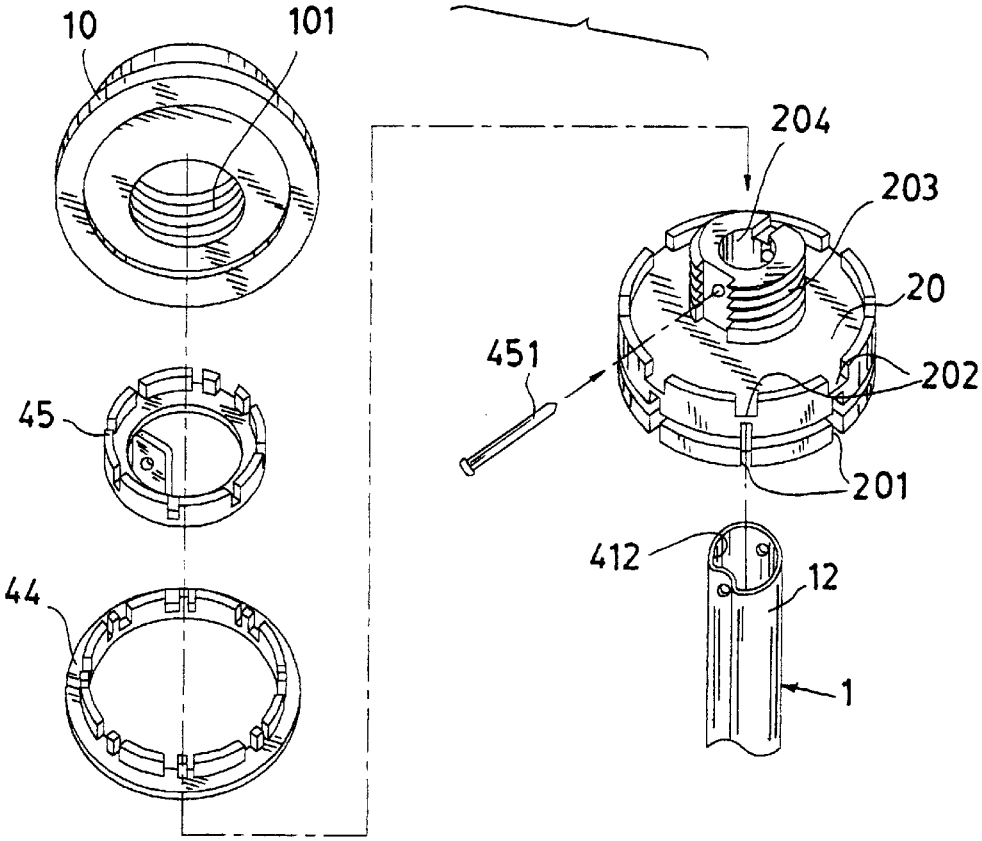

ILLUMINATING UMBRELLA HAVING RELIABLE CONNECTING WIRES

BACKGROUND OF THE INVENTION

A conventional illuminating umbrella is shown in FIGS. 1–4 including a top bulb B fixed on a top end of a central shaft S of the umbrella, and a plurality of ball-tip bulbs B1 respectively fixed on the ends of the umbrella ribs for safety illuminative purpose.

However, the wires W as electrically connected from the bulbs B, B1 to a power source generally fixed in the grip of the central shaft S may be twisted, stretched, or bent either upwardly or downwardly when opening or closing the umbrella among the upper notch U, the shaft S and the rib assembly R, thereby easily breaking the wires connected between the bulbs B, B1 and the power source without lighting the bulbs.

Meanwhile, so many wires W are assembled (A) in the tiny tube of the central shaft as shown in FIG. 3 to increase the difficulty for connecting the wires such as by soldering.

The present inventor has found the drawbacks of the conventional illuminating umbrella, and invented the present illuminating umbrella having reliable connecting wires.

SUMMARY OF THE INVENTION

The object of the present invention is to provide an illuminating umbrella including a top illuminator fixed on a top end of an umbrella central shaft, a plurality of tip illuminators respectively fixed on a plurality of tips of the top ribs of the umbrella; each illuminator having a positive wire electrically connected to a positive conducting ring secured on an outer peripheral portion of an umbrella notch or ferrule formed on an upper end of the central shaft, and having a negative wire electrically connected to a negative conducting ring embedded on the central shaft which serves as a negative conductor, with the positive conducting ring electrically connected to a positive pole of a power source, of which the negative pole is electrically connected to the central shaft through an on-off switch slidably held on a grip of the shaft thereby forming a reliable stable power connection circuit among the illuminators and the power source; and a flasher connected between the power source and the illuminators for flashing the illuminators when turned on.

BRIEF DESCRIPTION OF THE DRAWINGS

FIG. 5 is an exploded view of the present invention.

FIG. 6 is a sectional drawing of a tip illuminator of the present invention.

FIG. 7 is a cross sectional drawing as viewed from 7—7 direction of FIG. 5.

FIG. 8 is a cross sectional drawing as viewed from 8—8 direction of FIG. 5.

FIG. 9 is a perspective view showing the positive and negative conducting rings of the present invention.

FIG. 10 is an illustration of the positive and negative conducting rings when assembled and fixed on the upper notch of the umbrella, also showing a connection of wires through the wire slot in the notch.

FIG. 11 shows another preferred embodiment for power connection of the positive and negative conducting rings, also showing the connection of wires through the wire slot in the notch.

FIG. 19 is a perspective view showing the positive, negative conducting rings and the related parts thereof, as provided in FIG. 18.

FIG. 20 is an illustration showing the assembled conducting rings from FIG. 19, also showing the wires connected to the related rings through the wire slots apart from the rib slots in the notch.

DETAILED DESCRIPTION

Figures 1, 2:
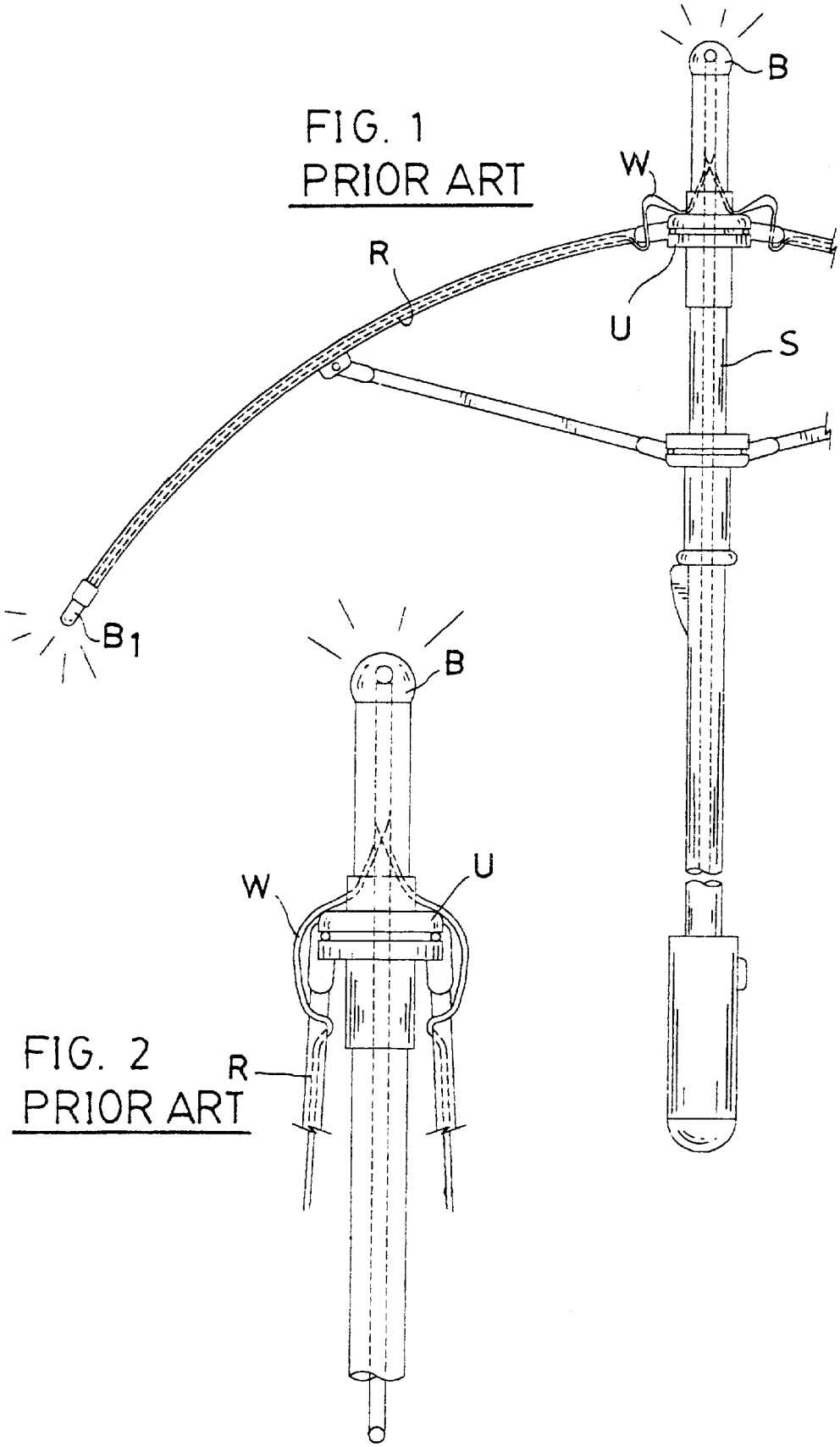
FIG. 1 PRIOR ART
FIG. 2 PRIOR ART
FIG. 1 shows a conventional illuminating umbrella as opened.
FIG. 2 shows a closed conventional umbrella.
Figure 3:
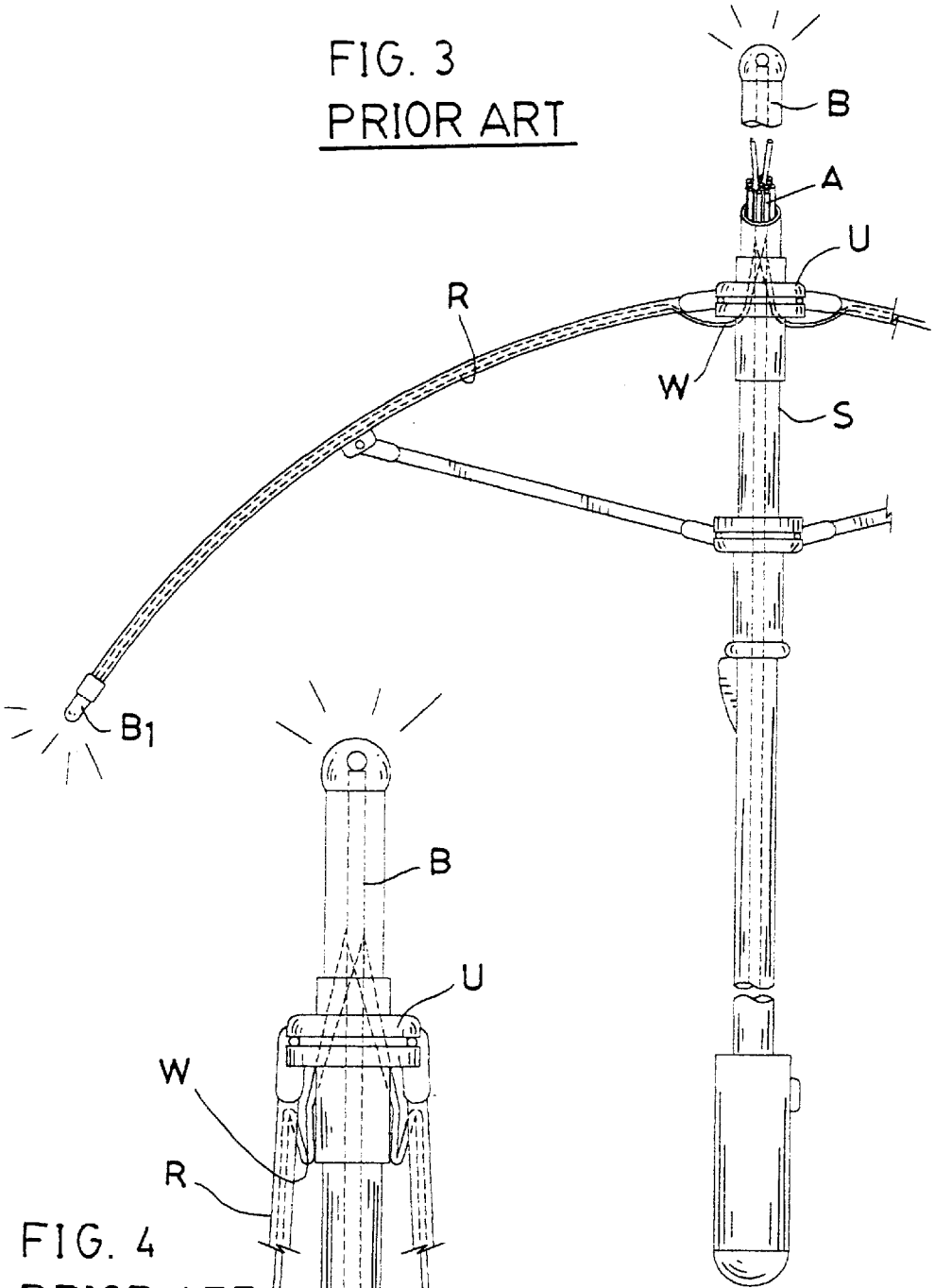
FIG. 3 PRIOR ART
FIG. 3 shows another conventional illuminating umbrella when opened.
Figure 4:
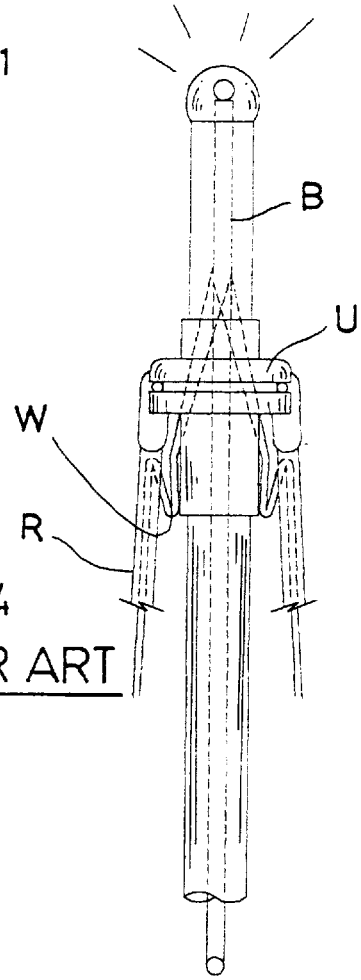
FIG. 4 PRIOR ART
FIG. 4 shows the closed umbrella from FIG. 3.

As shown in FIGS. 5–14, the present invention comprises: a central shaft 1 having a grip 11 formed on a lower portion of the shaft 1; a rib assembly 2 having at least a top rib 21 pivotally secured to an upper notch 20 fixed on a top portion 12 of the shaft 1, and a stretcher rib 22 pivotally secured to each top rib 21 and a lower runner 23 slidably held on the shaft 1; an illuminating means 3 including a top illuminator 31 which may be a bulb or a light-emitting diode (LED) fixed on a top end of the shaft 1 and a plurality of tip illuminators 32 each fixed on a tip end (or outer end) of each top rib 21 and each tip illuminator 32, which may be a light-emitting diode (LED), parallelly electrically connected to a power source; and a power supply means 4 for powering the illuminators 31, 32. An umbrella cloth is provided to cover the rib assembly 2.

The top illuminator 31 has a positive wire P electrically connected to a positive conducting ring 44 fixed on an outer peripheral portion of the upper notch 20 which may be made of electrically insulative material, and a negative wire N electrically connected to a negative conducting ring 45 embedded or fixed on the central shaft 1 which may be made of electrically conductive material.

Figures 12, 13, 14:
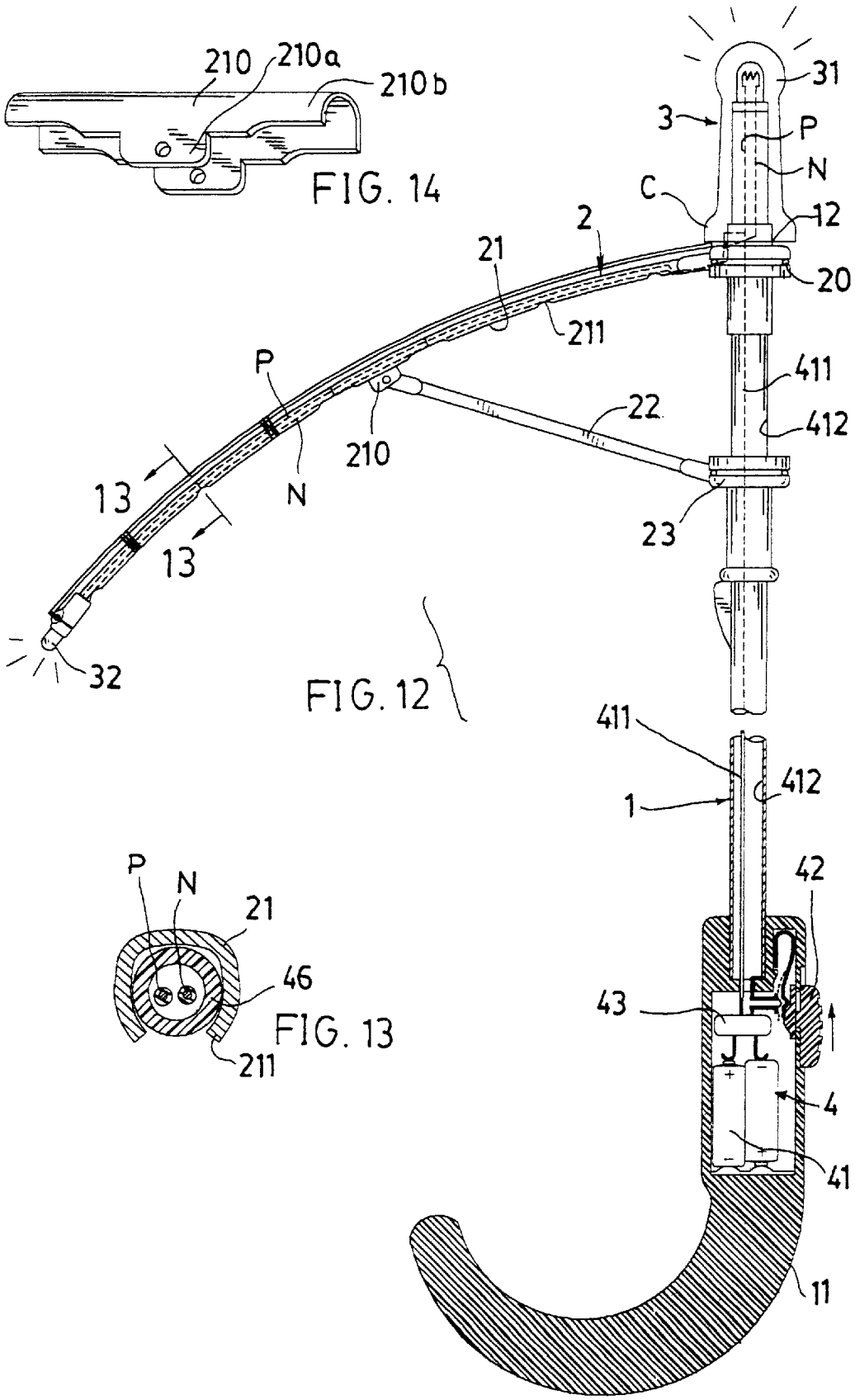
FIG. 12 is an illustration of the present invention when opened.
FIG. 13 is a cross sectional drawing as viewed from 13—13 direction of FIG. 12.
FIG. 14 shows a joint member on the top rib of the present invention.

Each tip illuminator 32 has a positive wire P electrically connected to the positive conducting ring 44, and a negative wire N electrically connected to the negative conducting ring 45, both wires P, N being disposed within at least a protective tube 46 such as a PVC tube which is clamped within the top rib 21 having a cross section of U shape having a pair of crimping edges 211 bent inwardly for clamping the protective tube 46 within the top rib 21 as shown in FIG. 13.

Each positive or negative wire should be covered (or integrally formed) with electrically insulative sheath.

The positive and negative wires P, N of each tip illuminator 32 are led through an electric-wire slot 202 juxtapositioned to each rib slot 201 formed in the upper notch 20 for pivotally securing each top rib 21 on the upper notch 20, preferably passing under a fastening wire 200 wound on the upper notch 20 for pivotally fastening the top ribs 21 on the notch 20, and then respectively connected to the positive and negative conducting rings 44, 45 such as by soldering or other connection methods.

Each wire slot 202 for the positive or negative wire P, N is juxtapositioned to each rib slot 201 for the top rib 21 to thereby prevent or minimize the twisting, tangling, bending, stretching or even breaking drawbacks as found in a conventional illuminating umbrella.

Therefore, the present invention provides an illuminating umbrella having reliable stable electric-wire connection for prolonging the service life of the illuminators 31, 32 on the umbrella.

The positive conducting ring 44 is electrically connected to the positive pole of the power source 41, which may be a battery or batteries stored in the grip 11 made of electrically insulative material, through an externally insulated positive conductor 411 passing through a hole 121 formed through the shaft and through an interior in the central shaft 1; while the negative conducting ring 45 electrically connected to the negative pole of the power source 41 through a negative conductor 412 which may be formed in situ on the central shaft 1 as made of electrically conductive material, or may be another externally insulated conductor wire or strip (not shown) in the shaft 1.

Between the power source 41 and the two conducting rings 44, 45, a flasher 43 and an on-off switch 42 are electrically connected therebetween. The on-off switch 42 is slidably held on the grip 11 for switching on (or off) the power source 41 for actuating (or deactivating) the flasher 43 which may be an integrated circuit for intermittently turning on the illuminators 31, 32 for flashing and alarming purpose especially in a night time.

The top illuminator 31 and the two conducting rings 44, 45 may be covered with a transparent insulative cap C for water proof purpose for preventing short circuit of the positive and negative conducting rings 44, 45 and the wires P, N as shown in FIG. 12.

In each U-shaped top rib 21, two protective tubes 46 may be provided on opposite sides of the joint member 210 which includes a pair of lugs 210*a* tapered downwardly from two side tube portions 210*b* (FIG. 14).

Each tip illuminator 32 includes a holder 321 secured on an outer tip portion of each top rib 21 and each protective tube 46 as shown in FIGS. 6, 5, and an outer sleeve 322 circumferentially jacketed on the holder 321 for securing an umbrella cloth (not shown). The outer sleeve 322 is derived from the conventional rib tip, but now served for protecting the tip illuminator 32.

The holder 321 has a lug L engageable with a slot H formed in the outer sleeve 322, while the top rib 21 having a lug L1 engageable with the slot H1 formed in the holder 321, thereby enforcing their mutual locking and engagement to be firmly fixed on a rib tip end of each top rib 21.

Figure 15:
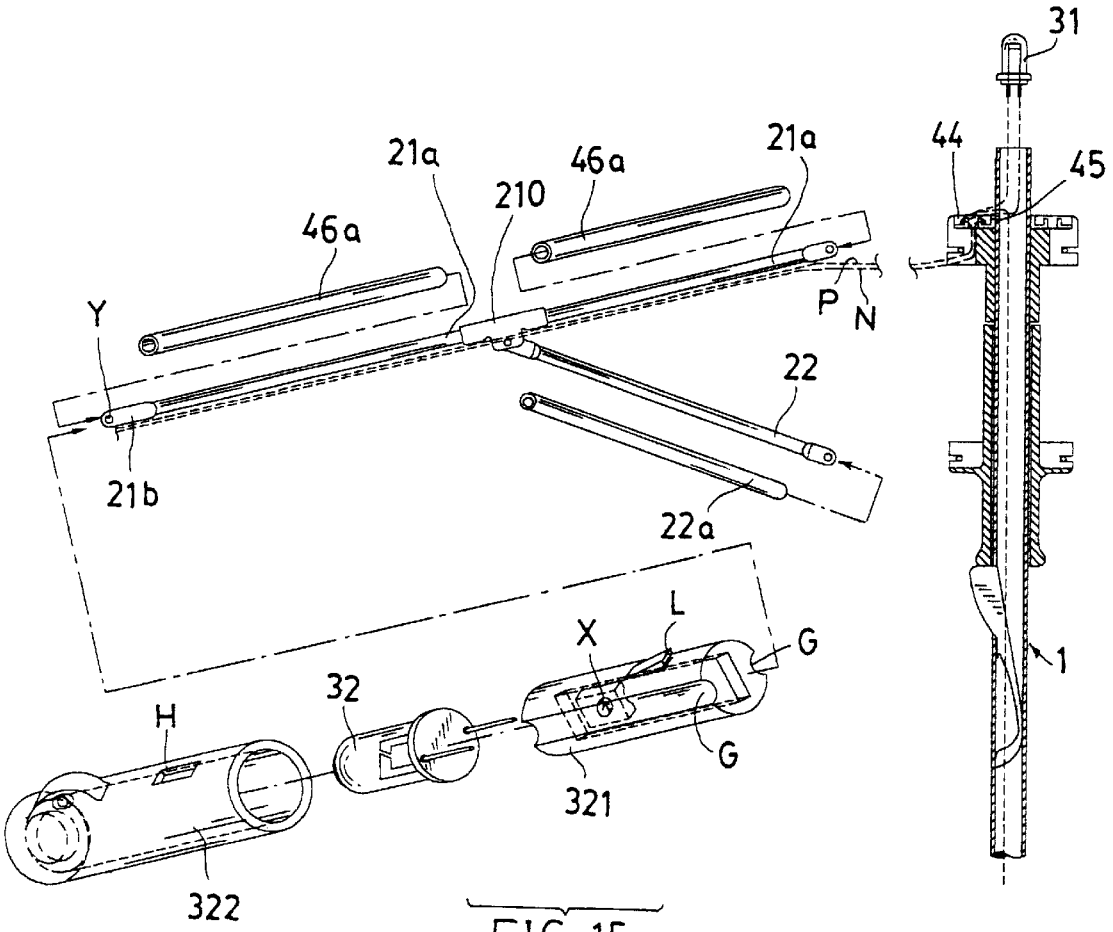
FIG. 15 shows another preferred embodiment of the present invention.
Figure 16:
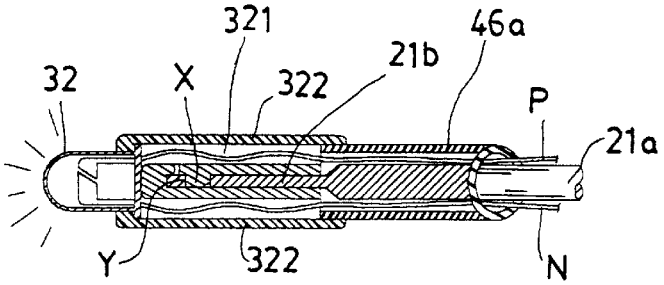
FIG. 16 is a sectional drawing of the tip illuminator when assembled from FIG. 15.

Another preferred embodiment of the present invention is shown in FIGS. 15, 16, in which, the top rib is modified to be a solid rib 21*a* to be disposed within a protective (PVC or plastic) tube 46*a* having the positive and negative wires P, N held within the protective tube and disposed about the solid rib 21*a*.

The holder 321 has two grooves G for passing the two wires P, N and having a protrusion X for engaging the hole Y formed on the end portion of the top rib 21*a*. The holder 321 is then coupled within the sleeve 322 which is fixed on an outer portion of the tube 46*a*.

For decorative purpose, the protective tubes 46*a* for the top rib 21*a* and the tube 22*a* for the stretcher rib 22 may be formed as colorful tubes.

Still another preferred embodiment of the present invention is shown in FIGS. 17–20 which is a two-fold illuminating umbrella.

The central shaft I includes a lower tube la and an upper tube 1*b* telescopically engageable with the lower tube 1*a*.

The negative conducting ring 45 is secured on a male-threaded collar 203 on an inner portion of the upper notch 20 by an electrically conductive pin 451 to electrically connect the top portion 12 of the central shaft 1 inserted into a central hole 204 in the collar 203.

The positive conducting ring 44 is secured on an outer peripheral portion of the upper notch 20 to electrically connect the positive conductor 411 passing through the central shaft 1.

A top cap 10 having a female-threaded hole 101 formed therein is engaged with the male-threaded collar 203 for covering the positive and negative conducting rings 44, 45 on the upper notch 20.

Each tip illuminator 32 has a positive wire P and a negative wire N respectively connected to the positive conducting ring 44 and the negative conducting ring 45 by passing through each wire slot 202 formed in an upper portion of the upper notch 20 as juxtapositioned to each rib slot 201 formed in a lower portion of the upper notch 20.

The rib assembly 2 includes a top rib 21 pivotally connected with the upper notch 20 and a stretcher rib 22 pivotally connected to the runner 23 slid on the shaft 1, an outer rib 24 pivotally connected with the stretcher rib 22 and connected with a connecting link 25 which is pivotally connected to the top rib 21.

Figures 17, 18:
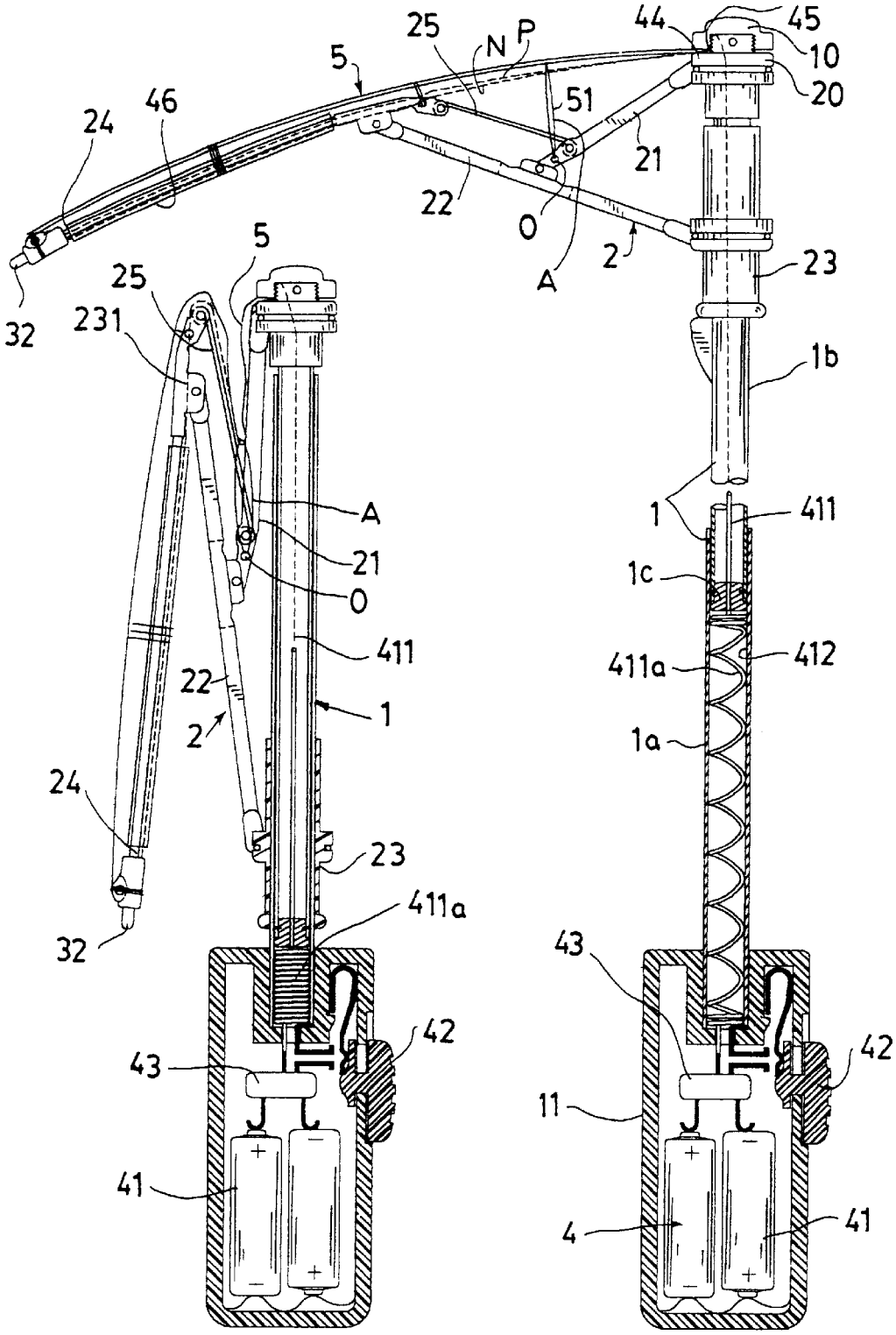
FIG. 17 shows still another preferred embodiment of the present invention when opened.
FIG. 18 shows the closed umbrella from FIG. 17.

The wires P, N connected to each tip illuminator 32 are led through a protective tube 46 clamped in the outer rib 24 and then electrically connected to the two conducting rings 44, 45 as fastened by a fastener member 51 of the umbrella cloth 5 secured on the rib assembly 2 (FIG. 17).

The wire connection on the upper notch is not influenced by the top ribs 21 because the wire slots 202 are positioned above the rib slots 201 for pivotally connecting the top rib 21, thereby enhancing a reliable power connection for the wires P, N of the illuminators 32.

Since the upper tube 1*b* is telescopically engageable with the lower tube 1*a*, the positive conductor 411 is connected with a coiled conductor 411*a* telescopically wound in the lower tube la as shown in FIGS. 17, 18 having a plug 1*c* plugged in a lower end of the upper tube 1*b* for retaining an upper end of the coiled conductor 411*a*. Such a coiled conductor 411*a* will allow the telescopic movement of the tubes 1*a*, 1*b* of the central shaft 1 when folding or opening the umbrella without breaking the positive conductor 411.

The present invention may be further modified without departing from the spirit and scope of this invention. The flasher 43 is a flasing driver which may be integrated circuit exerting pulses for flashing the illuminators.

What is claimed is:

1. An illuminating umbrella comprising:

a central shaft having a grip formed on a lower portion of said shaft;

a rib assembly having at least a top rib pivotally secured to an upper notch fixed on a top portion of said shaft, and a stretcher rib pivotally connected to said top rib and a runner slidably held on said shaft;

an illuminating means including a top illuminator secured on a top of said shaft, and at least a tip illuminator which is fixed on a holder fixed on an outer end of said top rib, having an outer sleeve jacketed on a circumference of said holder for firmly securing said tip illuminator and for securing an umbrella cloth on said sleeve; and a power supply means including a power source of at least a battery stored in said grip, an on-off switch slidably formed on said grip for switching on or off said power source, a positive conducting ring formed on an outer peripheral portion of said upper notch for electrically connecting a positive pole of each said illuminator through an externally insulated positive wire and electrically connected to a positive pole of the power source through a positive conductor passing through an interior in said shaft, and a negative conducting ring secured on said central shaft for electrically connecting a negative pole of each said illuminator through an externally insulated negative wire and electrically connected to a negative pole of said power source through the on-off switch by a negative conductor in said shaft, and a flasher connected between said illuminators and said power source for operatively flashing said illuminators when switching on said switch.

2. An illuminating umbrella according to claim 1, wherein each said illuminator is a light-emitting diode.

3. An illuminating umbrella according to claim 1, wherein said negative conductor is formed on said central shaft which is made of electrically conductive material.

4. An illuminating umbrella according to claim 1, wherein each said tip illuminator has said positive and negative wires disposed in a protective tube clamped in said top rib having a cross section of U shape and having a pair of crimping edge portions of said top rib bent inwardly for clamping said protective tube therein.

5. An illuminating umbrella according to claim 4, wherein said tip illuminator is fixed on a holder fixed on an outer end of said top rib, having an outer sleeve jacketed on a circumference of said holder for firmly securing said tip illuminator and for securing an umbrella cloth on said sleeve.

6. An illuminating umbrella according to claim 1, wherein each said tip illuminator has said positive wire and said negative wire led from each said top rib into a wire slot, which is formed in said upper notch and is juxtapositioned to a rib slot formed in said upper notch for pivotally securing each said top rib on said upper notch, and then respectively connected to said positive and negative conducting rings.

7. An illuminating umbrella according to claim 1, wherein each said top rib is a solid rib, having said positive and negative wires connected to each said tip illuminator and disposed about a circumference surface of said solid rib and having at least a protective tube jacketed on said solid rib to cover said positive and negative wires within said protective tube.

8. An illuminating umbrella according to claim 7, wherein each said tip illuminator is fixed on a holder having a pair of grooves recessed on opposite side portions of said holder for holding said positive and negative wires in said pair of grooves; said holder fixed on an outer end of said solid rib and having an outer sleeve jacketed on said holder and secured on an outer end portion of said protective tube.

* * * * *